US008971759B2

(12) United States Patent
Kim

(10) Patent No.: US 8,971,759 B2
(45) Date of Patent: Mar. 3, 2015

(54) IMAGE FORMING APPARATUS

(71) Applicant: Samsung Electronics Co., Ltd., Suwon-si, Gyeonggi-do (KR)

(72) Inventor: Hyun Soo Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 108 days.

(21) Appl. No.: 13/715,201

(22) Filed: Dec. 14, 2012

(65) Prior Publication Data

US 2013/0188987 A1 Jul. 25, 2013

(30) Foreign Application Priority Data

Dec. 16, 2011 (KR) ..... 10-2011-0136506

(51) Int. Cl.
*G03G 15/20* (2006.01)
*G03G 15/06* (2006.01)
*G03G 21/18* (2006.01)

(52) U.S. Cl.
CPC ..... *G03G 15/06* (2013.01); *G03G 21/1842* (2013.01); *G03G 2221/183* (2013.01); *G03G 21/1853* (2013.01); *G03G 2221/1657* (2013.01); *G03G 2221/1884* (2013.01); *G03G 2221/1654* (2013.01)
USPC ..... 399/111

(58) Field of Classification Search
CPC ..... G03G 15/20
USPC ..... 399/111
See application file for complete search history.

(56) References Cited

U.S. PATENT DOCUMENTS

| | | | | |
|---|---|---|---|---|
| 5,402,212 | A * | 3/1995 | Ito et al. | 399/111 |
| 6,381,430 | B1 * | 4/2002 | Yokomori et al. | 399/119 |
| 7,920,807 | B2 * | 4/2011 | Tomatsu | 399/112 |
| 8,145,096 | B2 * | 3/2012 | Kawanami et al. | 399/111 |
| 8,521,060 | B2 * | 8/2013 | Numata et al. | 399/111 |
| 8,649,705 | B2 * | 2/2014 | Nozawa et al. | 399/111 |
| 2013/0188987 | A1 * | 7/2013 | Kim | 399/111 |

* cited by examiner

*Primary Examiner* — Clayton E Laballe
*Assistant Examiner* — Kevin Butler
(74) *Attorney, Agent, or Firm* — Staas & Halsey LLP

(57) ABSTRACT

An image forming apparatus capable of preventing a developing cartridge mounted at the image forming apparatus from being damaged by an outside impact in a process of transporting the image forming apparatus. The image forming apparatus comprises at least one developing cartridge each having an image carrier to form an image, at least one supporting frame configured to support the at least one developing cartridge installed at an inside the body, and at least one buffer member configured to ease impact that occurs between the at least one developing cartridge and the at least one supporting frame by being disposed in between the at least one developing cartridge and the at least one supporting frame, the at least one buffer member provided to be removed before the at least one developing cartridge starts an initial printing operation.

21 Claims, 9 Drawing Sheets

IMAGE FORMING APPARATUS

CROSS-REFERENCE TO RELATED APPLICATIONS

This application claims the benefit of Korean Patent Application No. 10-2011-0136506, filed on Dec. 16, 2011, in the Korean Intellectual Property Office, the disclosure of which is incorporated herein by reference.

BACKGROUND

1. Field

The embodiments of the present disclosure relate to an image forming apparatus having a structure to protect a developing cartridge from an outside impact.

2. Description of the Related Art

An image forming apparatus is an apparatus configured to form an image on a printing medium according to a signal which is input, and includes a printer, a photocopying apparatus, a facsimile, and a multi-functional apparatus having the functions of the printer, the photocopying apparatus, and the facsimile consolidated therein.

An electro-photographic image forming apparatus, which is a type of an image forming apparatus, is provided therein with a developing cartridge, which has an image carrier and a developing apparatus, and a laser scanning unit. The laser scanning unit scans laser on an image carrier charged with a predetermined electric potential and forms a latent electrostatic image on the surface of the image carrier, and the developing apparatus supplies a developer on the image carrier, at which the latent electrostatic image is formed, to form a visible imagery.

In order to maintain a constant quality of images, the developing apparatus is needed to be disposed at a constant position at an inside portion of the body of the image forming apparatus at all times, and thus, at an inside portion of the body of the image forming apparatus is provided therein with a supporting unit, which is configured to support the developing apparatus as to have the developing apparatus disposed at a designated position at all times.

An outside impact that may occur in the process of the image forming apparatus being transported, a potion of the developing apparatus, which is formed of material having relatively weaker strength than the supporting unit, may be damaged as the developing apparatus repeatedly comes into contact with the supporting unit and moves away from the supporting unit that supports the developing apparatus. In a case when a portion of the developing apparatus is damaged, the developing apparatus is then deviated from the designated position, and particularly, the position of a component that is needed to be provided with a precise position control, such as an image carrier, is also being deviated from the designated position, thereby resulting in a reduced quality of the image.

SUMMARY

Therefore, it is an aspect of the present disclosure to provide an image forming apparatus capable of preventing a developing cartridge mounted at the image forming apparatus from being damaged by an outside impact.

Another aspect of the present disclosure is to provide an image forming apparatus capable of detecting whether a member, which is configured to prevent the damage of a developing cartridge, is removed prior to starting an initial printing operation of the image forming apparatus.

Additional aspects will be set forth in part in the description which follows and, in part, will be obvious from the description, or may be learned by practice of the disclosure.

In accordance with one aspect, an image forming apparatus includes a body, a cover, a tray, at least one developing cartridge, at least one supporting frame, and at least one buffer member. The cover may be configured to open/close one side of the body. The tray may be movably mounted at the body in a sliding manner through the one side of the body that is open/closed by the cover. The at least one developing cartridge may be mounted at an inside the body, the at least one developing cartridge each having an image carrier to form an image. The at least one supporting frame may be configured to support the at least one developing cartridge installed inside the body. The at least one buffer member may be configured to ease impact that occurs between the at least one developing cartridge and the at least one supporting frame by being disposed in between the at least one developing cartridge and the at least one supporting frame. Wherein, the at least one buffer member provided to be removed before the at least one developing cartridge starts an initial printing operation.

The at least one buffer member may be provided in a form of a strap.

The at least one buffer member may be mounted at the body together with the tray and the at least one developing cartridge while in a state of being coupled to the tray.

The buffer member may be disposed at a left side and a right side at an inner portion of the tray with respect to a mounting direction of the tray such that the buffer member makes contact with opposite ends of the at least one developing cartridge in a state that the at least one developing cartridge is accommodated at the tray.

The at least one developing cartridge may include a supporting block to support opposite ends of the image carrier such that the image carrier is rotated. The at least one supporting frame may include an accommodating groove configured to accommodate and support the supporting block. At least one portion of the at least one buffer member may be disposed in between the supporting block and the accommodating groove, so that impact that occurs between the supporting block and the accommodating groove is eased.

The at least one buffer member may be provided in a shape corresponding to a lower end portion of the at least one developing cartridge.

The at least one supporting frame, in a state when the buffer member is removed, may be configured to make direct contact with a lower end portion of the at least one developing cartridge, to determine a developing position of the at least one developing cartridge.

A high voltage board, which is configured to supply voltage to drive the at least one developing cartridge mounted at the body, may be disposed at one side of the body. The at least one developing cartridge, in order to be supplied with voltage from the high-voltage board, may be provided at one side thereof with at least one connecting terminal.

The image forming apparatus may further include at least one blocking member, which is positioned in between the high-voltage board and the at least one connecting terminal to block the electrical connection between the high-voltage board and the at least one connecting terminal, the at least one blocking member provided to be removed before the at least one developing cartridge starts an initial printing operation.

The image forming apparatus may further include a detection unit to detect an electrical connection status between the high-voltage board and the at least one connecting terminal. The detection unit, in a case when the high-voltage board is electrically connected to the at least one connecting terminal, may enable a printing operation to be performed, and in a case when the high-voltage board is electrically blocked from the at least one connecting terminal, enable a printing operation not to be performed.

The at least one blocking member may be integrally connected to the buffer member, and may be removed together with the buffer member before the at least one developing cartridge starts an initial printing operation.

The at least one buffer member may be mounted at the body together with the tray and the at least one developing cartridge while in a state of being coupled to the at least one developing cartridge.

The at least one buffer member may be provided in a form that surrounds an outer side of one end portion of the developing cartridge.

In accordance with another aspect, an image forming apparatus may include a body, at least one developing cartridge, a tray, at least one supporting frame, and at least one buffer member. The at least one developing cartridge each may have an image carrier mounted at an inside the body to form an image and a supporting block to rotatively support the image carrier. The tray may be detachably coupled at the body while accommodating the at least one developing cartridge. The tray may have a plurality of supporting units, which supports the at least one developing cartridge, and a plurality of opening units formed in between the plurality of supporting units. The at least one supporting frame may be configured to support the supporting block, which is exposed through the plurality of opening units, while coupled to opposite sides of the body, and to determine a position of the image carrier. The at least one buffer member may have at least a portion thereof positioned between the supporting block and the at least one supporting frame to ease impact that occurs between the supporting block and the at least one supporting frame, the at least one buffer member provided to be removed before the at least one developing cartridge starts an initial printing operation.

The at least one buffer member may be provided in a form of a strap, and may be mounted at the body together with the tray and the at least one developing cartridge while in a state of being supported by the plurality of supporting units.

The at least one supporting frame may include an accommodating groove configured to accommodate and support the supporting block, while at least a portion of the at least one buffer member is disposed in between the supporting block and the accommodating groove, so that the impact that occurs between the supporting block and the accommodating groove is eased.

The at least one buffer member may be provided in a form of a strap, and may be mounted at the body together with the tray and the at least one developing cartridge while in a state of being coupled to the at least one developing cartridge.

The image forming apparatus may include a high voltage board, at least one connecting terminal and at least one blocking member. The high voltage board may be disposed at one side of the body and configured to supply voltage to drive the at least one developing cartridge mounted at the body. The at least one connecting terminal may be provided at one side of the at least one developing cartridge to be supplied with power by making contact with the high-voltage board. The at least one blocking member may be positioned in between the high-voltage board and the at least one connecting terminal to block a contact between the high-voltage board and the at least one connecting terminal while being provided to be removed before the at least one developing cartridge starts an initial printing operation.

The at least one blocking member may be integrally connected to the buffer member, and may be removed together with the buffer member before the at least one developing cartridge starts an initial printing operation.

As described above, the embodiments of the present disclosure, a phenomenon of reduced quality of an image, due to a developing cartridge mounted at an image forming apparatus is damaged by an outside impact that occurs in the transporting process of the image forming apparatus, may be prevented.

In addition, a malfunction that may occur by driving an image forming apparatus without removing a buffer member may be prevented in advance.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
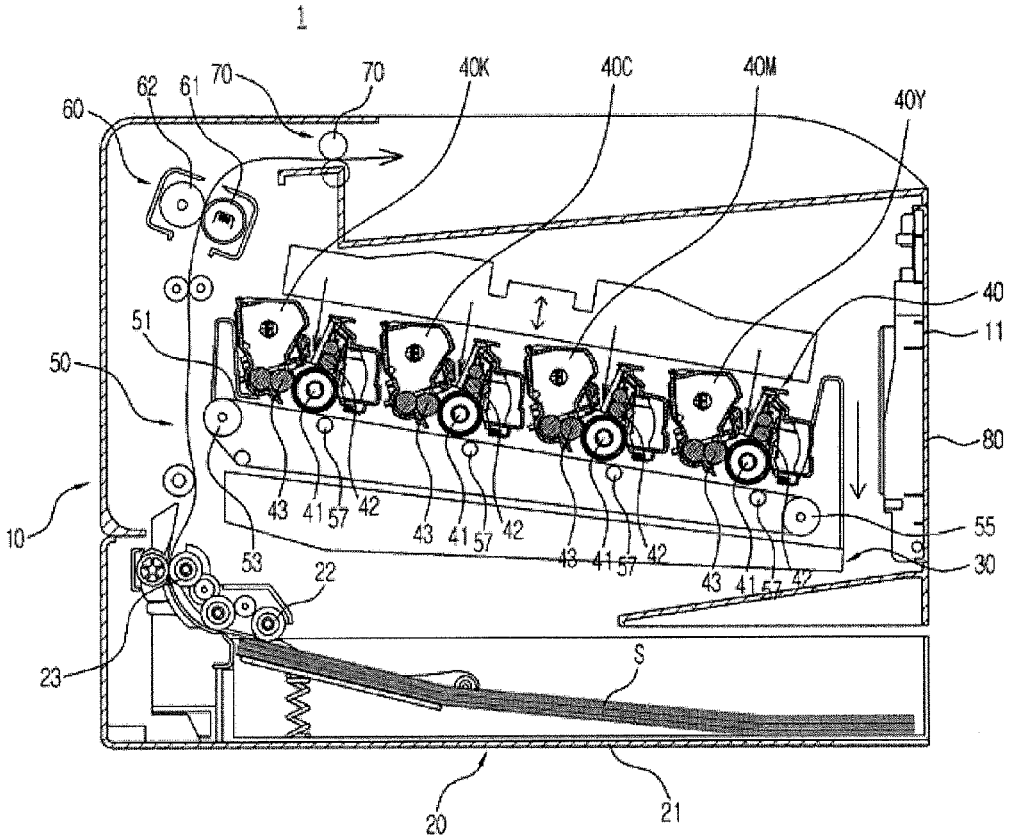
FIG. 1 is a drawing schematically illustrating a structure of an image forming apparatus in accordance with one embodiment.

Reference will now be made in detail to the embodiments, examples of which are illustrated in the accompanying drawings, wherein like reference numerals refer to like elements throughout.

Figure 2:
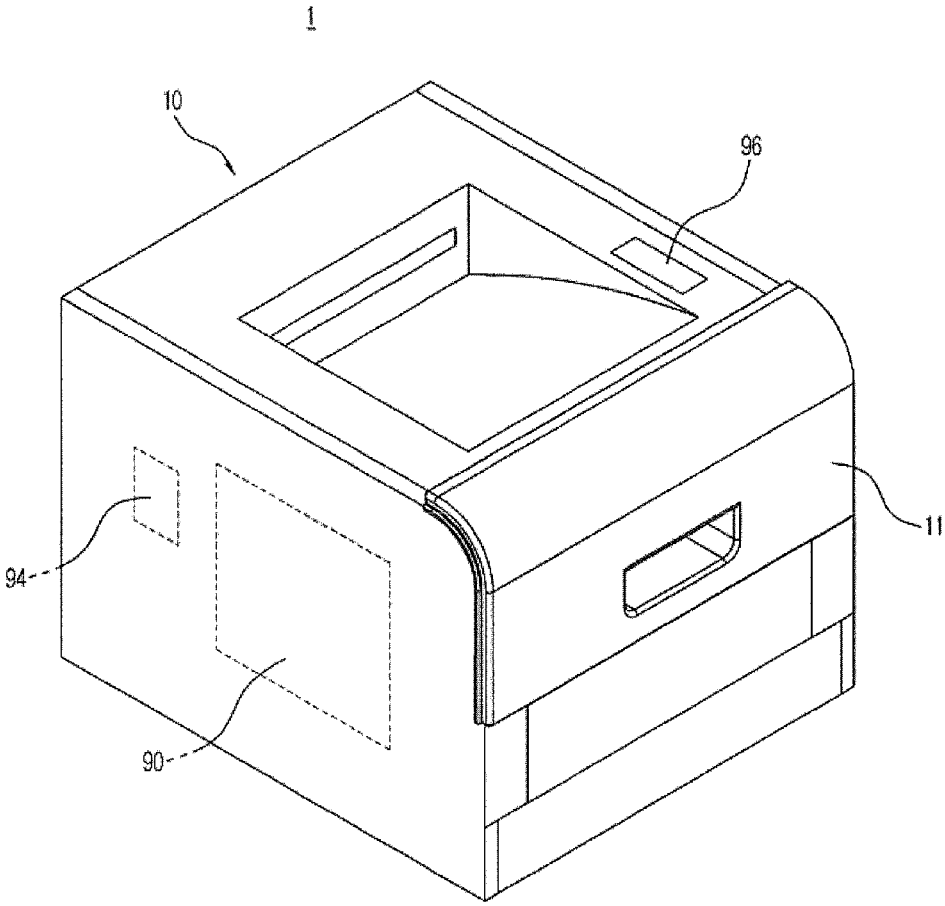
FIG. 2 is a perspective view of an exterior appearance of an image forming apparatus in accordance with one embodiment.

FIG. 1 is a drawing schematically illustrating a structure of an image forming apparatus in accordance with one embodiment, and FIG. 2 is a perspective view of an exterior appearance of an image forming apparatus in accordance with one embodiment.

As illustrated on FIG. 1, an image forming apparatus 1 includes a body 1, a printing medium supply unit 20, a laser scanning unit 30, a developing cartridge 40, a transfer unit 50, a fusing unit 60, and a printing medium discharging unit 70.

The body 10 forms an exterior of the image forming apparatus 1, and supports various components installed at an inside the body 10. In addition, at one side of the body 10, a cover 11 is rotatively installed. The cover 11 is configured to open/close one portion of the body 10. A user, through the cover 11, approaches to an inside the body 10, and may attach/detach a compartment such as the developing cartridge 40.

The printing medium supply unit 20 includes a cassette 21 in which a printing medium S is stored, a pick-up roller 22 configured to pick up the printing medium S stored at the cassette 21 one sheet at a time, and a transporting roller 23 configured to transport the printing medium, which is picked up, toward the transfer unit 50.

The laser scanning unit 30 is disposed at an upper portion of the developing cartridge 40 to emit the laser, which corresponds to the imagery information, to an image carrier 41, and forms a latent electrostatic image on the surface of the image carrier 41.

The developing cartridge 40 includes four developing cartridges 40Y, 40M, 40C, and 40K in which the developers having different colors to each other, for example, yellow Y, magenta M, cyanide C, and black K, are accommodated, respectively.

The each of the developing cartridges 40Y, 40M, 40C, and 40K is provided thereto with the image carrier 41, a charging roller 42, a developing roller 43, and a supplying roller (not shown). On the surface of the image carrier 41, a latent electrostatic image is formed by the laser scanning unit 30. The charging roller 42 transfers the image carrier 41 in a predetermined electric potential. The supplying roller (not shown) supplies a developer to the developing roller 43, and the developing roller 43 attaches a developer on the surface of the image carrier 41, on which a latent electrostatic image is formed, to form a visible imagery.

The transfer unit 50 includes a transfer belt 51 configured to drive in a circulating manner while making contact with the each of the developing cartridges 40Y, 40M, 40C, and 40K, a driving roller 53 configured to drive the transfer belt 51, a tension roller 55 providing a constant tension to the transfer belt 51, and a plurality of transfer roller 57 configured to transfer the visible image, which is developed on the each image carrier 41 of the each of the developing cartridges 40Y, 40M, 40C, and 40K, to a printing medium P.

A fusing unit 60 includes a heating roller 61 having a heat source, and a pressing roller 62 installed while corresponding to the heating roller 61. When a printing medium passes through in between the heating roller 61 and the pressing roller 62, by the heat delivered from the heating roller 61 and the pressure applied in between the heating roller 61 and the pressing roller 62, an image is fused on the printing medium.

The printing medium discharging unit 70 includes a plurality of delivery rollers 71 to discharge a printing medium passed through the fusing unit 60 to an outside the body 10.

The each of the developing cartridges 40Y, 40M, 40C, and 40K, is mounted at an inside the body 10 while being accommodated at a tray 80, which is movably coupled to the body 10 in a sliding manner. The tray 80 includes a plurality of supporting units 82 (FIG. 6) supporting the developing cartridges 40Y, 40M, 40C, and 40K, and a plurality of opening units 84 (FIG. 6) formed in between the plurality of supporting units 82.

At one side of the body 10, a high-voltage board 90 is disposed to supply power to drive the each of the developing cartridges 40Y, 40M, 40C, and 40K that are mounted at the body 10. The power of the high-voltage board 90 is delivered to the image carrier 41, the charging roller 42, the developing roller 43, and the supplying roller (not shown) by passing through linking terminals (refer to 86 in FIG. 6) provided on the tray 80 and connecting terminals 47 respectively provided at one side of the each of the developing cartridges 40Y, 40M, 40C, and 40K.

At an inside the body 10, a detection unit 94 is provided to detect the electrical connection status between the high-voltage board 90 and the each connecting terminals 47. In a case when the high-voltage board 90 is electrically connected to the connecting terminals 47, the detection unit 94 enables a printing operation to be performed, and in a case when the high-voltage board 90 is electrically blocked from the connecting terminals 47, the detection unit 94 may enable a printing operation not to be performed.

A display unit 96 is configured to display information about the image forming apparatus 1 or an operation status of the image forming apparatus 1. In a case when the detection unit 94 detects that the electrical connection between the high-voltage board 90 and the connecting terminals 47 is blocked, the display unit 96 displays to a user that the developing cartridges 40Y, 40M, 40C, and 40K are not normally mounted at the body 10.

Figure 3:
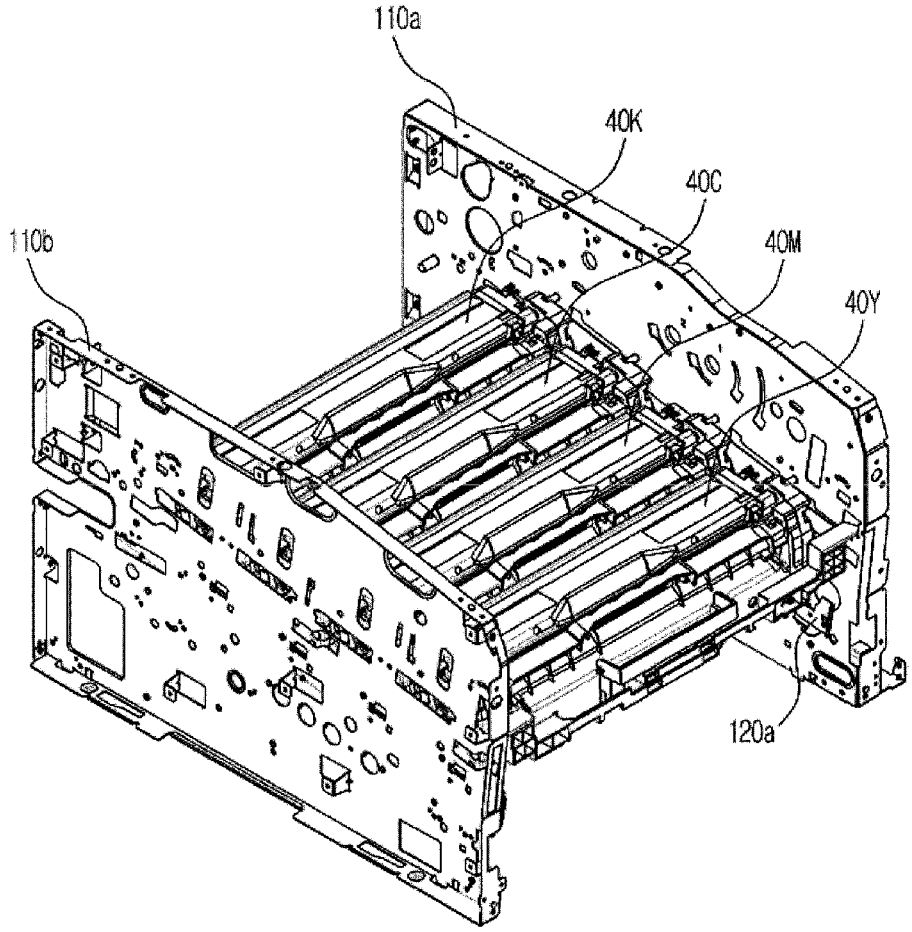
FIG. 3 is a drawing illustrating a developing cartridge being mounted at a body.
Figure 4:
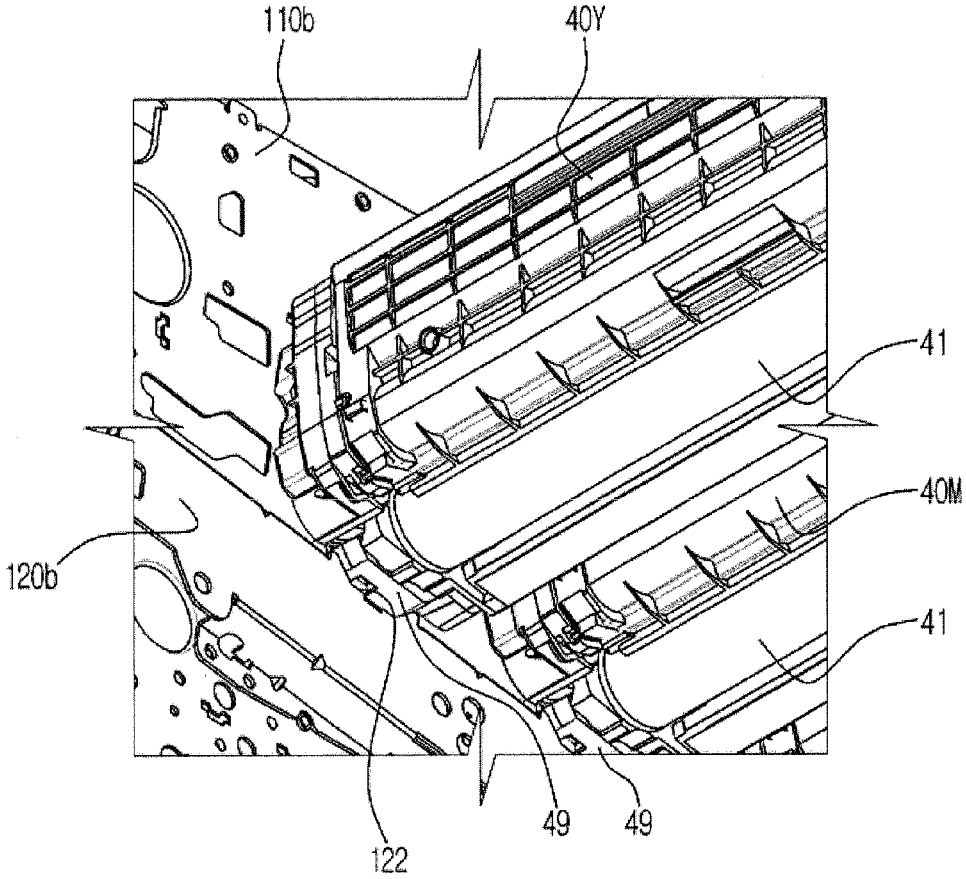
FIG. 4 is a drawing illustrating a developing cartridge being supported by a supporting frame.
Figure 5:
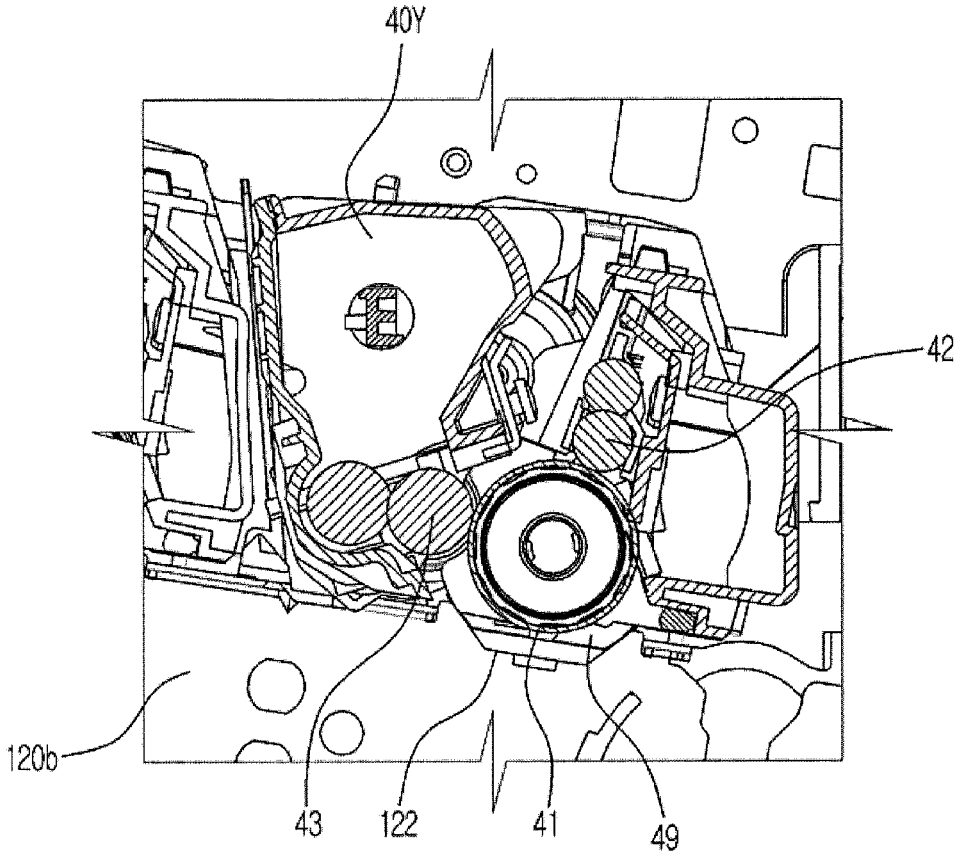
FIG. 5 is a side view illustrating a developing cartridge being supported by a supporting frame.

FIG. 3 is a drawing illustrating a developing cartridge is mounted at a body, FIG. 4 is a drawing illustrating a developing cartridge being supported by a supporting frame, and FIG. 5 is a side view illustrating a developing cartridge being supported by a supporting frame.

As illustrated on FIGS. 1 to 5, main frames 110*a* and 110*b* are provided at opposite sides of the body 10 to support various components that structures the image forming apparatus 1, and a supporting frame 120*a* and a supporting frame 120*b* are coupled to corresponding inner sides of the main frames 110*a* and 110*b*, respectively, to support the each of the developing cartridges 40Y, 40M, 40C, and 40K mounted at an inside the body 10.

The supporting frames 120*a* and 120*b* are coupled to the corresponding inner sides of the main frames 110*a* and 110*b* in a direction of the tray 80 being attached/detached at the body 10, and by supporting the both end portions of the each of the developing cartridges 40Y, 40M, 40C, and 40K, the supporting frame 120*a* and 120*b* determine the developing position of the each of the developing cartridges 40Y, 40M, 40C, and 40K. As illustrated on FIG. 1, in order to maintain the uniform quality of images, a certain distance between the image carrier 41 and the plurality of transfer rollers 57 is needed to be maintained, and in order to maintain a certain distance between the image carrier 41 and the plurality of transfer rollers 57, the each of the developing cartridges 40Y, 40M, 40C, and 40K is needed to be disposed at a constant position at an inside the body 10 at all times. The supporting frame 120*a* and 120*b* support the each of the developing cartridges 40Y, 40M, 40C, and 40K, so that the each of the developing cartridges 40Y, 40M, 40C, and 40K may perform a developing operation at a constant developing position.

The each of the developing cartridges 40Y, 40M, 40C, and 40K includes a supporting block 49 that supports both end portions of the image carrier 41 so as to rotate the image carrier 41. The supporting frames 120*a* and 120*b*, includes an accommodating groove 122 configured to accommodate and support the supporting block 49, which is exposed through the opening unit 84 in a state of the each of the developing cartridges 40Y, 40M, 40C, and 40K being mounted at the body 10

The supporting block 49 is configured to support the center of rotation of the image carrier 41, and the position of the center of rotation of the image carrier 41 is determined according to the position of the supporting block 49 being settled at the accommodating groove 122. The quality of images is maintained at a constant manner when the position of the center of rotation of the image carrier 41 is constant at all times.

In a state of shipping and transporting the image forming apparatus 1 while the each of the developing cartridges 40Y, 40M, 40C, and 40K is being mounted at the body 10, by the impact and the vibration of an outside, a contact impact between the supporting block 49 and the accommodating groove 122 may occur, and thereby the supporting block 49 or the accommodating groove 122 may be damaged. In a case when the supporting block 49 is formed with plastic material, which is relatively weaker in strength than the supporting frames 120*a* and 120*b* formed with metallic material, the supporting block 49, when compared to the supporting frames 120*a* and 120*b*, is more likely to be damaged. The damage of the supporting block 49 refers to the state of the position of the center of rotation of the image carrier 41 being diverged from the originally determined position, and the above leads into poor quality of images.

Thus, prior to an initial printing operation, a buffer member 140 is mounted to prevent the supporting block 49, which determines the positions of the developing cartridges 40Y, 40M, 40C, and 40K, and more particularly, the image carrier 41 that is directly linked to the quality of images, from being damaged from an outside impact that may occur in the process of shipping and transporting the image forming apparatus 1.

Figure 6:
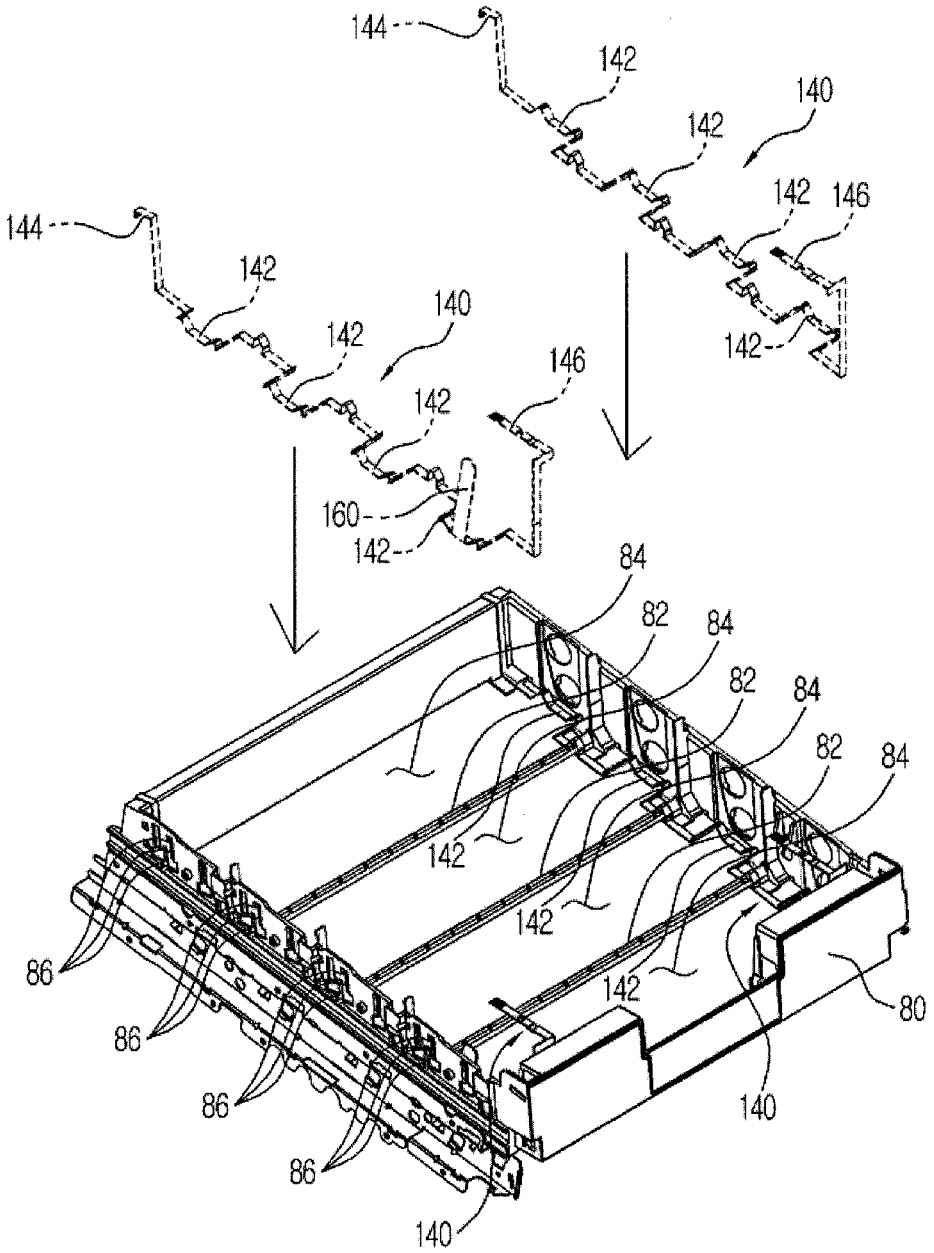
FIG. 6 illustrates a buffer member in accordance with one embodiment of the present disclosure, the buffer member being coupled to a tray prior to an initial printing operation.
Figure 7:
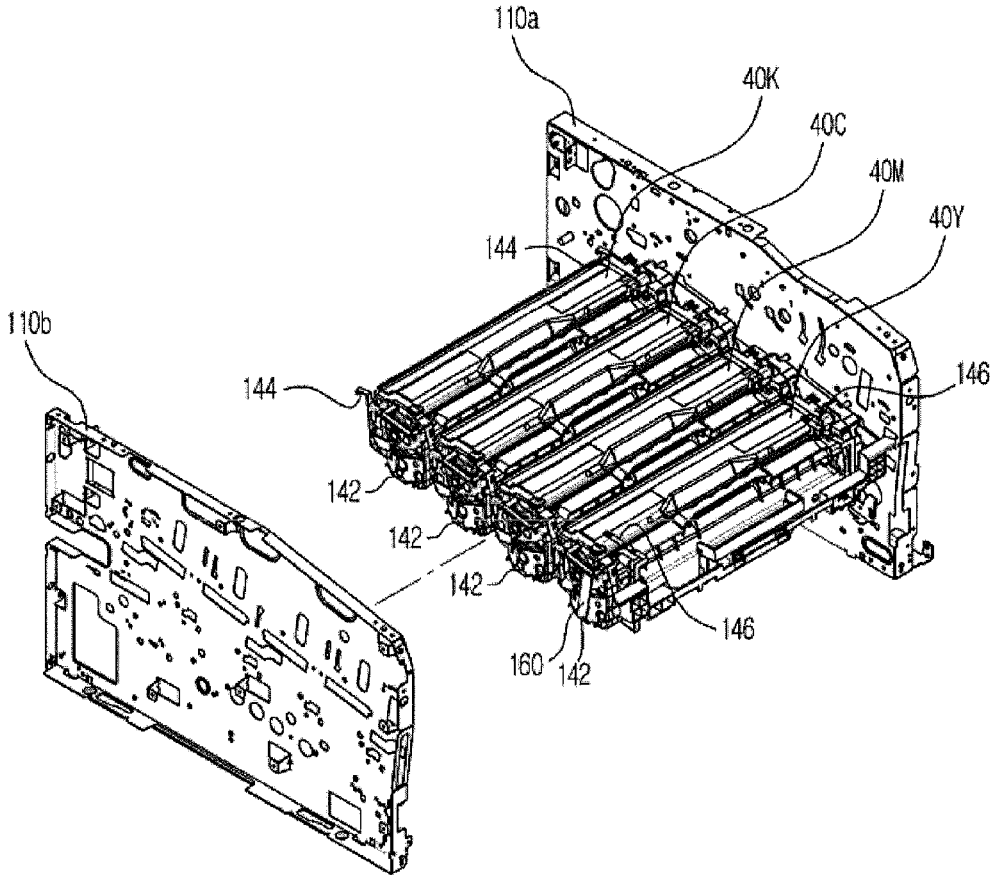
FIG. 7 is a drawing illustrating a buffer member being mounted at a body.
Figure 8:
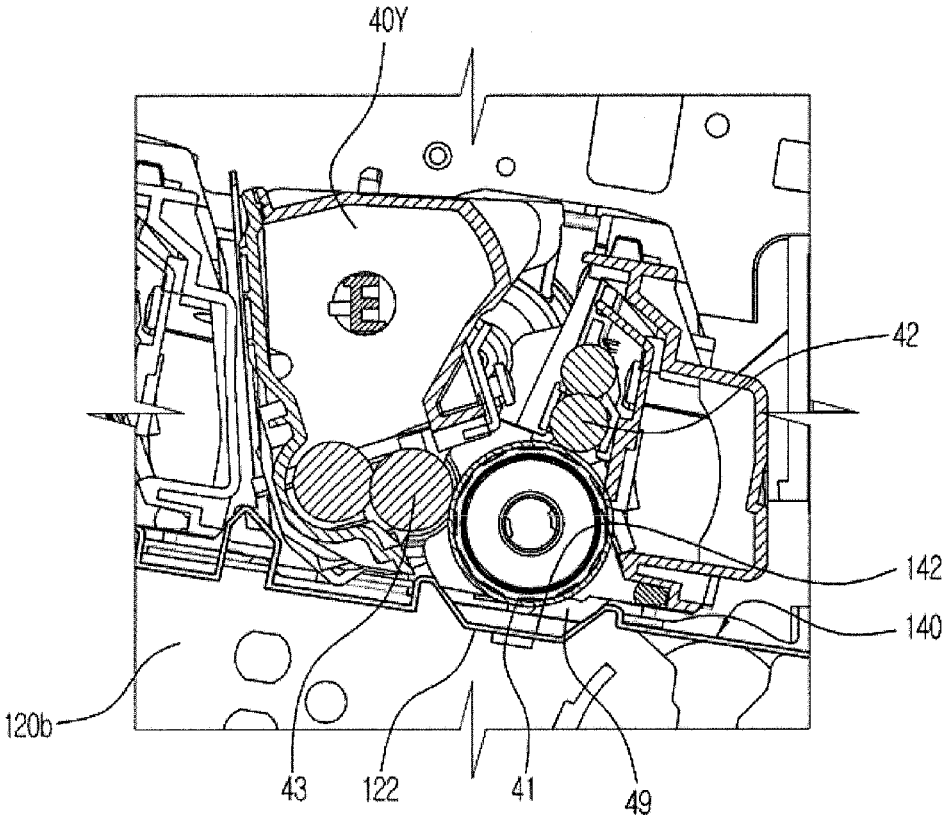
FIG. 8 is a side view illustrating a developing cartridge being supported by a supporting frame while a buffer member is coupled to a tray and is mounted at a body.

FIG. 6 illustrates a buffer member in accordance with one embodiment, and is a drawing illustrating the buffer member being coupled to a tray prior to an initial printing operation, FIG. 7 is a drawing illustrating a buffer member being mounted at a body, and FIG. 8 is a side view illustrating a developing cartridge being supported by a supporting frame while a buffer member is coupled to a tray and is mounted at a body.

As illustrated on FIGS. 6 to 8, the buffer member 140 is provided in a shape corresponding to a lower end portion of the developing cartridges 40Y, 40M, 40C, and 40K and is positioned in between the developing cartridges 40Y, 40M, 40C, and 40K and the supporting frames 120*a* and 120*b* prior to an initial printing operation to ease the impact that may occur between the developing cartridges 40Y, 40M, 40C, and 40K and the supporting frames 120*a* and 120*b*.

In particular, at least one portion of the buffer member 140 is provided in a form that corresponds to the supporting block 49, and is positioned in between the supporting block 49 and the accommodating groove 122 to ease the impact that may occur in between the supporting block 49 and the accommodating groove 122, thereby preventing the supporting block 49 from being damaged by an outside impact. And thus, in the process of the image forming apparatus 1 performing a printing operation after the buffer member 140 is removed, the center of rotation of the image carrier 41 that is supported by the supporting block 49 may be disposed at a constant position.

The buffer member 140 may be disposed beforehand at a left side and at a right side of an inside the tray 80 with respect to a direction of the tray 80 being mounted, so that the buffer member 140 may be able to make contact with the opposite ends of each of the developing cartridges 40Y, 40M, 40C, and 40K in a state that the developing cartridges 40Y, 40M, 40C, and 40K are accommodated at the tray 80. The buffer member 140 is supported by the plurality of supporting units 82 and by a rear end of the tray 80. A hook unit 144 is provided at one end of the buffer member 140 so that the buffer member 140 may be supported by the rear end of the tray 80.

The buffer member 140 may be provided in a form of a strap, providing a user a convenience in removing the buffer member 140 easily, as the form thereof is easily modified, and includes a handle unit 146, which is protruded to an outside the tray 80, so that a user may be able to grip the buffer member 140 easily.

In the process of shipping and transporting the image forming apparatus 1, the buffer member 140 is mounted at the body 10 while being coupled to the tray 80, and is positioned in between the developing cartridges 40Y, 40M, 40C, and 40K and the supporting frames 120*a* and 120*b*.

The buffer member 140 is needed to be removed prior to an initial printing operation, so that a normal printing operation of the image forming apparatus 1 may take place, and in a case when the image forming apparatus 1 is operated without removing the buffer member 140, a normal printing operation of the image forming apparatus 1 may not take place, and thereby poor quality of images may occur. As the above, in order to prevent the malfunction of the image forming apparatus 1 beforehand as a result of not removing the buffer member 140, a blocking member 160 is provided for a user to remove the buffer member 140 prior to an initial printing operation is started.

The blocking member 160, prior to an initial printing operation, is positioned at least at one of the linking terminals 86 and the connecting terminals 47, and blocks the electrical connection between the high-voltage board 90 and the connecting terminals 47.

The blocking member 160 may be integrally connected to the buffer member 140, and is mounted at the body 10 together with the buffer member 140 while being coupled to the tray 80, and is removed together with the buffer member 140 prior to an initial printing operation is started at the image forming apparatus 1.

In a case when a user operates the image forming apparatus 1 while the buffer member 140 is not removed, the detection unit 94 detects that at least one electrical connection of the high-voltage board 90 and the connecting terminals 47 is blocked by the blocking member 160, and enables a printing operation not to be performed, and the display unit 96 displays to a user that the developing cartridges 40Y, 40M, 40C, and 40K are not normally mounted at the body 10 or that the buffer member 140 is present, so that a user may be able to remove the buffer member 140.

Figure 9:
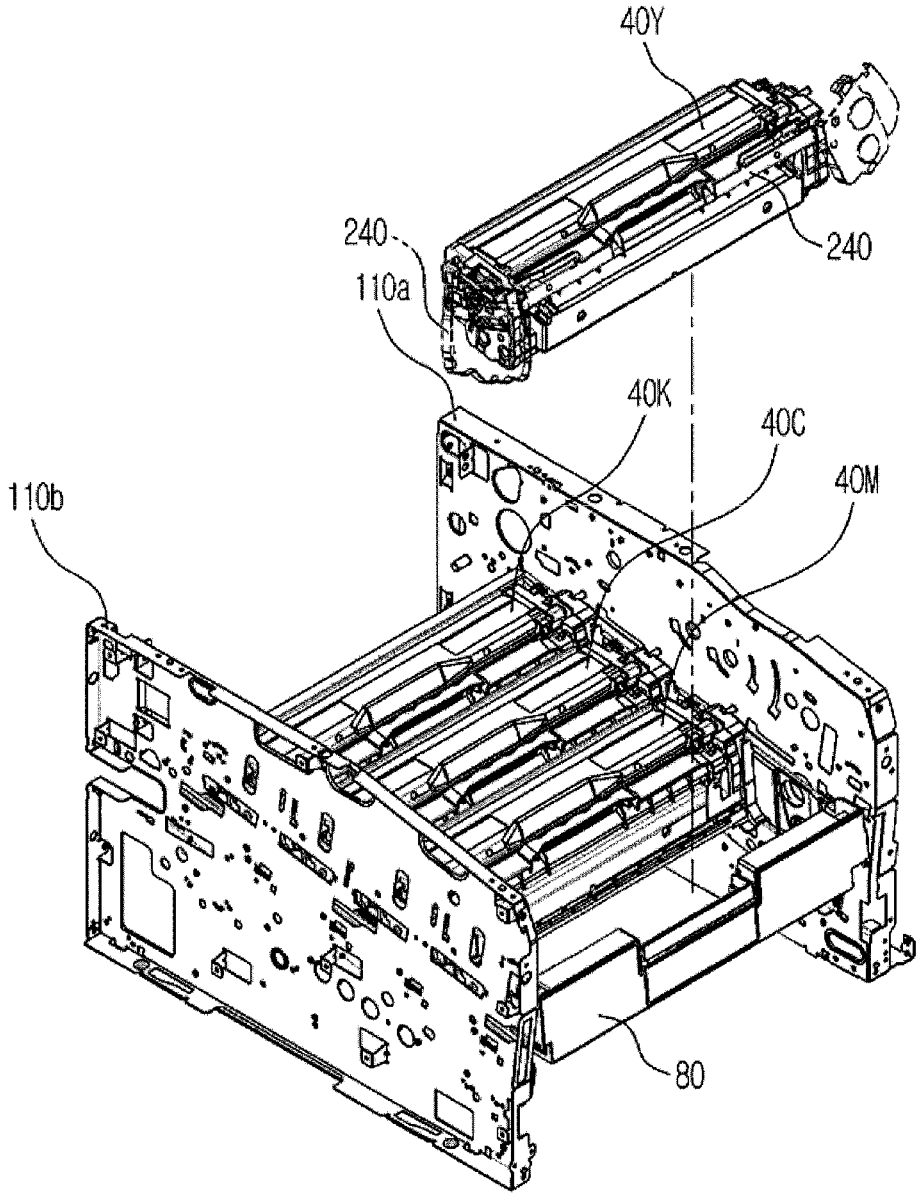
FIG. 9 illustrates a buffer member in accordance with one embodiment, the buffer member being coupled to a developing cartridge prior to an initial printing operation.

FIG. 9 illustrates a buffer member in accordance with one embodiment, and is a drawing illustrating the buffer member being coupled to a developing cartridge prior to an initial printing operation.

As illustrated on FIG. 9, a buffer member 240 is provided at an outer side of the developing cartridges 40Y, 40M, 40C, and 40K in a shape of corresponding to the developing cartridges 40Y, 40M, 40C so that the buffer member 240 may be able to surround at least an outer side of one end of the developing cartridges 40Y, 40M, 40C, and 40K, and is positioned in between the developing cartridges 40Y, 40M, 40C, and 40K and the supporting frames 120*a* and 120*b* prior to an initial printing operation to ease the impact that may occur between the developing cartridges 40Y, 40M, 40C, and 40K and the supporting frames 120*a* and 120*b*.

At least one portion of the buffer member 240 is provided with a form that corresponds to the supporting block 49, and is positioned in between the supporting block 49 and the accommodating groove 122 to ease the impact that may occur in between the supporting block 49 and the accommodating groove 122, thereby preventing the supporting block 49 from being damaged by an outside impact, and thus, in the process of the image forming apparatus 1 performing a printing operation, the center of rotation of the image carrier 41 that is supported by the supporting block 49 may be disposed at a constant position.

The buffer member 240 may be provided in a form of a strap, providing a user a convenience in removing the buffer member 140 easily, as the form thereof is easily modified.

The buffer member 240, while in a state of being coupled to the developing cartridges 40Y, 40M, 40C, and 40K, is mounted at the body 10 along with the tray 80 and with the developing cartridges 40Y, 40M, 40C, and 40K, which are accommodated at the tray 80, and is removed prior to an initial printing operation.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus, comprising:

a body;

a cover to open/close one side of the body;

a tray movably mounted at the body in a sliding manner through the one side of the body that is open/closed by the cover;

at least one developing cartridge mounted at an inside the body while being accommodated, the at least one developing cartridge each having an image carrier to form an image;

at least one supporting frame configured to support the at least one developing cartridge installed at an inside the body; and at least one buffer member configured to ease impact that occurs between the at least one developing cartridge and the at least one supporting frame, wherein the at least one buffer member configured to be removed before the image forming apparatus starts an initial printing operation.

2. The image forming apparatus of claim 1, wherein the at least one buffer member is provided in a form of a strap.

3. The image forming apparatus of claim 1, wherein the at least one buffer member is mounted at the body together with the tray and the at least one developing cartridge while in a state of being coupled to the tray.

4. The image forming apparatus of claim 3, wherein the buffer member is disposed at a left side and a right side at an inner portion of the tray with respect to a mounting direction of the tray such that the buffer member makes contact with opposite ends of the at least one developing cartridge in a state that the at least one developing cartridge is accommodated at the tray.

5. The image forming apparatus of claim 1, wherein:

the at least one developing cartridge comprises a supporting block to support opposite ends of the image carrier such that the image carrier is rotated;

the at least one supporting frame comprises an accommodating groove configured to accommodate and support the supporting block; and at least one portion of the at least one buffer member is disposed in between the supporting block and the accommodating groove, so that impact that occurs between the supporting block and the accommodating groove is eased.

6. The image forming apparatus of claim 1, wherein the at least one buffer member is provided in a shape corresponding to a lower end portion of the at least one developing cartridge.

7. The image forming apparatus of claim 1, wherein the at least one supporting frame, in a state when the buffer member is removed, is configured to make direct contact with a lower end portion of the at least one developing cartridge, to determine a developing position of the at least one developing cartridge.

8. The image forming apparatus of claim 1, wherein:

a high voltage board, which is configured to supply voltage to drive the at least one developing cartridge mounted at the body, is disposed at one side of the body; and the at least one developing cartridge is provided at one side thereof with at least one connecting terminal to be supplied with voltage from the high-voltage board.

9. The image forming apparatus of claim 8, further comprising at least one blocking member, which is positioned in between the high-voltage board and the at least one connecting terminal to block the electrical connection between the high-voltage board and the at least one connecting terminal, the at least one blocking member provided to be removed before the at least one developing cartridge starts an initial printing operation.

10. The image forming apparatus of claim 9, further comprising:

a detection unit to detect an electrical connection status between the high-voltage board and the at least one connecting terminal, wherein the detection unit, in a case when the high-voltage board is electrically connected to the at least one connecting terminal, enables a printing operation to be performed, and in a case when the high-voltage board is electrically blocked from the at least one connecting terminal, enables a printing operation not to be performed.

11. The image forming apparatus of claim 9, wherein the at least one blocking member is integrally connected to the buffer member, and is removed together with the buffer member before the at least one developing cartridge starts an initial printing operation.

12. The image forming apparatus of claim 1, wherein the at least one buffer member is mounted at the body together with the tray and the at least one developing cartridge while in a state of being coupled to the at least one developing cartridge.

13. The image forming apparatus of claim 12, wherein the at least one buffer member is provided in a form that surrounds an outer side of one end portion of the developing cartridge.

14. An image forming apparatus, comprising;

a body;

at least one developing cartridge each having an image carrier mounted at an inside the body to form an image and a supporting block to rotatively support the image carrier;

a tray detachably coupled at the body while accommodating the at least one developing cartridge, the tray having a plurality of supporting units, which supports the at least one developing cartridge, and a plurality of opening units formed in between the plurality of supporting units;

at least one supporting frame configured to support the supporting block, which is exposed through the plurality of opening units, while coupled to opposite sides of the body, and to determine a position of the image carrier; and at least one buffer member having at least a portion thereof positioned between the supporting block and the at least one supporting frame to ease impact that occurs between the supporting block and the at least one supporting frame, wherein the at least one buffer member configured to be removed before the image forming apparatus starts an initial printing operation.

15. The image forming apparatus of claim 14, wherein the at least one buffer member is provided in a form of a strap, and is mounted at the body together with the tray and the at least one developing cartridge while in a state of being supported by the plurality of supporting units.

16. The image forming apparatus of claim 14, wherein the at least one supporting frame comprises an accommodating groove configured to accommodate and support the supporting block, while at least a portion of the at least one buffer member is disposed in between the supporting block and the accommodating groove, so that the impact that occurs between the supporting block and the accommodating groove is eased.

17. The image forming apparatus of claim 14, wherein the at least one buffer member is provided in a form of a strap, and is mounted at the body together with the tray and the at least one developing cartridge while in a state of being coupled to the at least one developing cartridge.

18. The image forming apparatus of claim 14, comprising:

a high voltage board disposed at one side of the body and configured to supply voltage to drive the at least one developing cartridge mounted at the body, at least one connecting terminal provided at one side of the at least one developing cartridge to be supplied with power by making contact with the high-voltage board, and at least one blocking member positioned in between the high-voltage board and the at least one connecting terminal to block a contact between the high-voltage board and the at least one connecting terminal while being provided to be removed before the at least one developing cartridge starts an initial printing operation.

19. The image forming apparatus of claim 18, wherein the at least one blocking member is integrally connected to the buffer member, and is removed together with the buffer member before the at least one developing cartridge starts an initial printing operation.

20. An image forming apparatus, comprising;

a body;

at least one developing cartridge mounted at an inside the body while being accommodated, the at least one developing cartridge each having an image carrier to form an image;

at least one supporting frame configured to support the at least one developing cartridge installed at an inside the body a removable buffer member disposed at each side of the support frame between the at least one developing cartridge and the support frame to ease the impact that occurs between the support frame and the developing cartridge;

wherein the removable buffer member comprises at least one blocking member to prevent an electrical connection between the image forming apparatus and the developing cartridge.

21. The image forming apparatus of claim 1, wherein the at least one buffer member is disposed between the at least one developing cartridge and the at least one supporting frame.

* * * * *